United States Patent [19]

Ikeda et al.

[11] Patent Number: 4,990,064

[45] Date of Patent: Feb. 5, 1991

[54] MULTI-PISTON SWASH PLATE TYPE COMPRESSOR WITH INTERNAL LUBRICATING ARRANGEMENT

[75] Inventors: Hayato Ikeda; Hideo Mori; Kazuhiro Ohta, all of Kariya, Japan

[73] Assignee: Kabushiki Kaisha Toyoda Jidoshokki Seisakusho, Aichi, Japan

[21] Appl. No.: 389,740

[22] Filed: Aug. 4, 1989

[30] Foreign Application Priority Data

Aug. 8, 1988 [JP] Japan ..... 63-104803[U]

[51] Int. Cl.[5] ..... F04B 1/12

[52] U.S. Cl. ..... 417/269; 184/6.17

[58] Field of Search ..... 417/269; 184/6.17; 92/71

[56] References Cited

U.S. PATENT DOCUMENTS 3,057,545 10/1962 Ransom et al. ..... 417/269

3,955,899 5/1976 Nakayama et al. ..... 417/269

4,746,275 5/1988 Iwamori et al. ..... 417/269

*Primary Examiner*—A. Michael Chambers

*Attorney, Agent, or Firm*—Burgess, Ryan & Wayne

[57] ABSTRACT

A multi-piston swash plate type compressor with an internal lubricating arrangement for an air-conditioning system used in a vehicle such as an automobile including a cylinder block body having a swash plate chamber formed therein receiving a swash plate, cylinder bores formed therein for receiving pistons, and a central axial bore formed therein for receiving a driving shaft, the driving shaft being rotatably supported in the axial bore by radial bearings provided therein and by thrust bearings provided around the shaft at the sides of the swash plate. The compressor has suction and discharge chambers communicated with the cylinder bores through reed valves. The swash plate chamber is fed with a refrigerant inclusive of a lubricating oil from the air-conditioning system, and the refrigerant is then fed to the suction chamber through the axial bore. The thrust bearings have a race element surrounding the shaft, a clearance between the race element and the shaft being locally widened for increasing a flow rate of the refrigerant to be introduced into the axial bore through the thrust bearings.

6 Claims, 3 Drawing Sheets

MULTI-PISTON SWASH PLATE TYPE COMPRESSOR WITH INTERNAL LUBRICATING ARRANGEMENT

BACKGROUND OF THE INVENTION (1) Field of the Invention

The present invention relates to a compressor for an air-conditioning system used in a vehicle such as an automobile, and more particularly, to a multi-piston swash plate type compressor with an improved internal lubricating arrangement for radial bearings for rotatably supporting a driving shaft of the compressor.

(2) Description of the Related

As disclosed in, for example, U.S. Pat. Nos. 4,403,921, 4,381,178, and 4,746,275, an multi-piston swash plate type compressor comprises a cylinder block body assembled from a pair of cylinder block halves to form a swash plate chamber therebetween, the cylinder block halves having the same number of cylinder bores radially and concentrically formed with respect to the central axis of the cylinder block body.

The cylinder bores formed in one cylinder half are aligned with the cylinder bores formed in the other cylinder half, with the swash plate chamber intervening therebetween. Common pistons are slidably received in pairs of aligned cylinder bores, and a swash plate is disposed within the swash plate chamber to be slidably engaged with the common pistons so that the pistons are reciprocated in the pairs of aligned cylinder bores, by rotation of the swash plate. The swash plate is fixedly mounted on a driving shaft which extends into the cylinder block body so that it passes through the swash plate chamber. The driving shaft is adapted to be coupled to a prime motor of a vehicle for rotation of the swash plate. Two radial bearings are provided within the axial bore sections in the cylinder block halves, respectively, for rotatably supporting the driving shaft in the axial bore of the cylinder block body, and two thrust bearings are provided around the driving shaft and are disposed between the opposed central sides of the swash plate and the opposite inner central sides of the cylinder block halves, respectively.

Two dish-like housing members are mounted on the end faces of the cylinder block body, respectively, so as to form a suction chamber and a discharge chamber between each of the dish-like housing members and the corresponding end face of the cylinder block body. A disc-like reed valve assembly is disposed between each of the dish-like housing member and the corresponding end face of the cylinder block body and includes pairs of suction and discharge reed valve elements which are associated with the corresponding cylinder bores, so that each of the cylinder bores is communicated with the suction and discharge chambers through the corresponding pair of suction and discharge reed valve elements. The cylinder block halves, the dish-like housing member, and the disc-like reed valve assemblies are assembled as a unit by elongated screws extended into screw bores formed in these compressor components in the vicinity of the periphery thereof.

In U.S. Pat. No. 4,403,921, the swash plate chamber is in communication with the suction chambers through the screw bores and is fed with a refrigerant inclusive of a lubricating oil from an evaporator of an air-conditioning system. Namely, it is intended that the refrigerant inclusive of a lubricating oil be once introduced into the swash plate chamber and then directed to the suction chambers. This is because the movable parts (especially the thrust bearings and the radial bearings) provided within the swash plate chamber are lubricated by the lubricating oil included in the refrigerant. However, a large part of the refrigerant introduced to the swash plate chamber is directly fed to the suction chambers through the screw bores of the cylinder block halves without sufficient circulation within the swash plate chamber, so that it is impossible to obtain sufficient lubrication of the movable parts of the compressor.

In U.S. Pat. No. 4,381,178, it is suggested that the swash plate chamber be communicated with the suction chambers through the axial bores of the cylinder block halves, so that the refrigerant can be also fed from the swash plate chamber to the suction chamber through the axial bores for lubricating the thrust and radial bearings. However, a large part of the refrigerant has a tendency to flow from the swash plate chamber to the suction chamber through the screw bores because of the high flow resistance of the axial bore sections in the cylinder block halves, so that effective lubrication of the thrust and radial bearings cannot be carried out.

In U.S. Pat. No. 4,746,275, refrigerant flow passages are formed in the cylinder block halves in the vicinity of the axial bore sections thereof to introduce the refrigerant from the swash plate chamber into the suction chambers, so that a flow of the refrigerant is caused to be directed to a center of the swash plate chamber, whereby sufficient lubrication of the thrust bearings can be carried out. Although the refrigerant flow is caused to be directed to the center of the swash plate chamber by the refrigerant flow passages, it is impossible to sufficiently lubricate the radial bearings because the refrigerant cannot be introduced into the axial bore sections of the cylinder block halves through the thrust bearings. In particular, each of the thrust bearings has a pair of race elements which surround the driving shaft with a clearance on the order of 0.3 mm, so that the refrigerant cannot sufficiently enter into the axial bore sections of the cylinder block halves through the narrow clearance between the driving shaft and the race elements of the thrust bearings. For this reason, in U.S. Pat. No. 4,746,275, each of the refrigerant flow passages has a branch passage which is opened to the corresponding axial bore section to direct a part of the refrigerant from the refrigerant flow passages to the corresponding radial bearing. However, formation of the branch passage in the cylinder block halves is troublesome and costly.

If the formation of the branch passages is eliminated, that is, if the refrigerant inclusive of a lubricating oil is only fed to the radial bearings through the clearance of 0.3 mm between the driving shaft and the race elements of the thrust bearings, flaking may be caused in the radial bearings at a running time of about 3,000 hours because of insufficient lubrication thereof. On the other hand, the lubrication of the radial bearings may be improved by widening the clearance between the driving shaft and the race elements of the thrust bearings because the introduction of the refrigerant into the axial bore sections is facilitated due to the widened clearance. However, the widening of the clearance aggravates the undulation or wobble of the race elements of the thrust bearings during operation of the compressor, so that an undesirable play may be caused in the thrust bearings at a running time of about 2,000 hours.

SUMMARY OF THE INVENTION

Accordingly, it is an object of the present invention to provide a multi-piston swash plate type compressor which is so constructed that the refrigerant can be sufficiently introduced into the axial bore sections of the cylinder block halves through the thrust bearings without aggravating the undulation or wobble of the race elements of the thrust bearings, whereby effective lubrication of the radial bearings can be carried out.

In accordance with the present invention, there is provided a multi-piston swash plate type compressor for an air-conditioning system used in a vehicle such as an automobile which includes, in combination: a cylinder block means in which a swash plate chamber is formed for receiving a swash plate therein and which has cylinder bores radially and concentrically formed therein with a central axis of the cylinder block means, each of the cylinder bores receiving a piston so as to be slidably engaged with the swash plate to reciprocate the piston in the corresponding cylinder bore by rotation of the swash plate, the swash plate chamber being fed with a refrigerant inclusive of a lubricating oil from an evaporator of the air-conditioning system, the swash plate being fixedly mounted on a driving shaft which extends into the swash plate chamber through the cylinder block means and which is operatively connected to a prime motor of the vehicle for rotation of the swash plate, the driving shaft being rotatably supported in the axial bore of the cylinder block means by thrust bearing means provided around the driving shaft at the sides of the swash plate and by radial bearing means provided within the axial bore; housing means provided on the cylinder block means for forming a suction chamber which is communicated with the cylinder bores through a valve element and a discharge chamber which is communicated with the cylinder bores through a valve element, the suction chamber being in communication with the swash plate chamber through the axial bore of the cylinder block means, the discharge chamber being connected to a condenser of the air-conditioning system for feeding a compressed refrigerant thereto; and the thrust bearing means including a race element surrounding the driving shaft with a clearance therebetween, which has a narrow width, but is locally widened, whereby the refrigerant is able to be sufficiently introduced into the axial bore of the cylinder block means without aggravating undulation or wobble of the race element of the thrust bearing means, whereby effective lubrication of the radial bearing means is able to be carried out.

According to the present invention, there is also provided a multi-piston swash plate type compressor for an air-conditioning system used in a vehicle such as an automobile which includes: a cylinder block body which is assembled from a pair of cylinder block halves to form a swash plate chamber therebetween, the cylinder block halves having the same number of cylinder bores which are radially and concentrically formed therein with respect to a central axis of the cylinder block body, the cylinder bores formed in one cylinder block half being aligned with the cylinder block half formed in the other cylinder block half, with the swash plate chamber intervening therebetween; common pistons slidably received in the pairs of aligned cylinder bores; a swash plate member which is disposed within the swash plate chamber to be slidably engaged with the common pistons so that the pistons are reciprocated in the pairs of aligned cylinder bores, by rotation of the swash plate; a driving shaft which extends into an axial bore formed in the cylinder block body so that it passes through the swash plate chamber and on which the swash plate is fixedly mounted, the driving shaft being rotatably supported in the axial bore of the cylinder block body by a pair of thrust bearings provided around the driving shaft at the sides of the swash plate and by a pair of radial bearings provided within the axial bore sections in the cylinder block halves, a pair of dish-like housing members which are mounted on end faces the cylinder block body so as to form a suction chamber and a discharge chamber between each of the dish-like housing members and the corresponding end face of the cylinder block body; and a disc-like reed valve assembly which is disposed between each of the dish-like housing members and the corresponding end face of the cylinder block body so that each of the cylinder bores is communicated with the corresponding suction and discharge chambers through the corresponding suction and discharge reed valve elements of the disc-like reed valve assembly; each of the thrust bearings including first and second race elements and a plurality of roller elements disposed therebetween, the first race elements abutting against the corresponding side of the swash plate, the second race element abutting against an inner wall surface of the corresponding cylinder block half to surround the driving shaft with a clearance therebetween, which has a narrow width, but is locally widened, whereby the refrigerant is able to be sufficiently introduced into the axial bore section of the corresponding cylinder block half without aggravating undulation or wobble of the second race element, whereby effective lubrication of the radial bearings is able to be carried out.

In the present invention, the clearance between the driving shaft and the second race element may be 0.01 to 0.3 mm and may be locally widened by forming at least two recesses in the driving shaft, the recesses being disposed around the driving shaft at regular intervals. The clearance may be also locally widened by forming at least two notches in the second race element, the notches being disposed around an inner periphery of the second race element at regular intervals.

BRIEF DESCRIPTION OF THE DRAWINGS

This and other objects of the present invention will be better understood from the following description, with reference to the accompanying drawings, in which.

DESCRIPTION OF THE PREFERRED EMBODIMENTS

Figure 1:
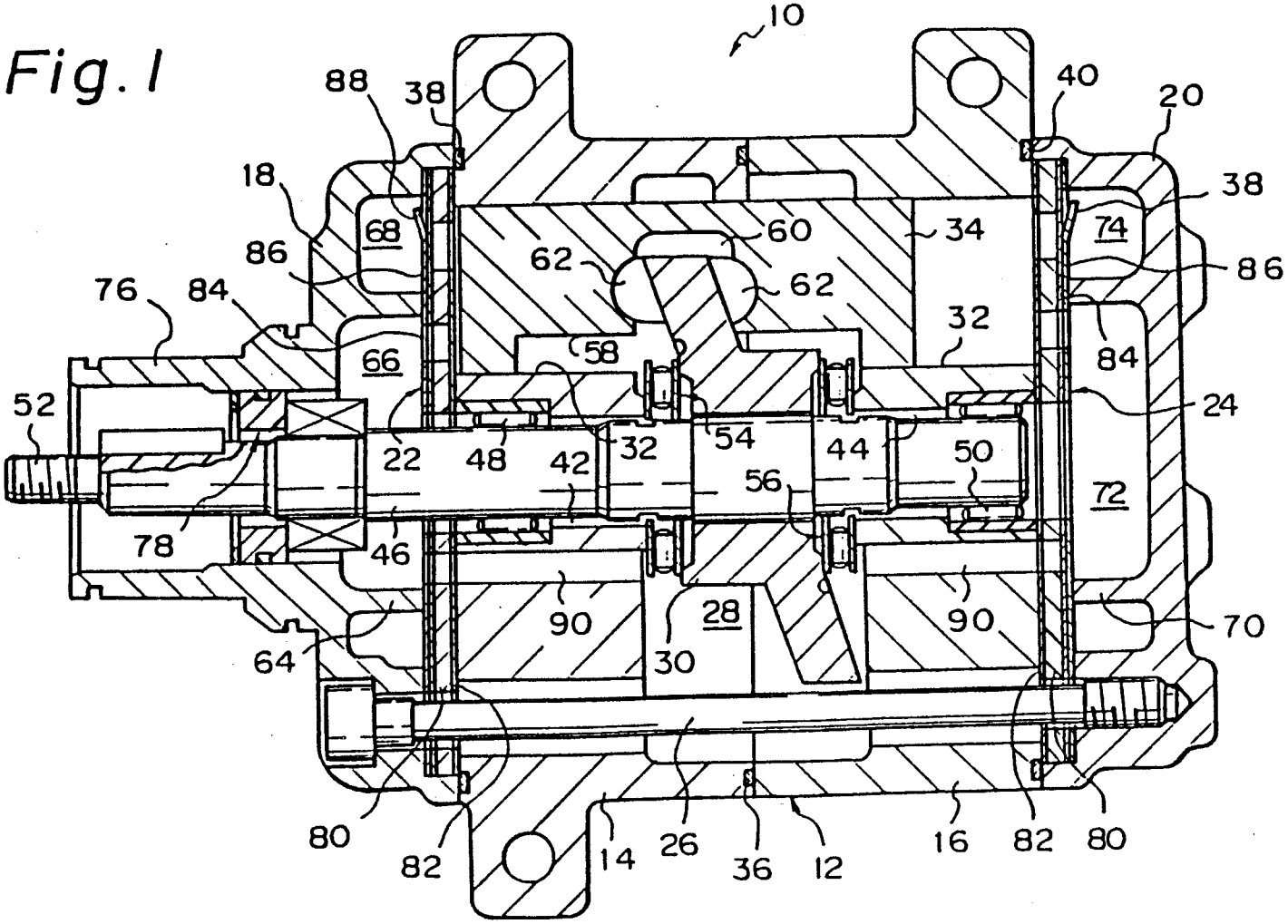
FIG. 1 is a longitudinal sectional view of a multi-piston swash plate type compressor constructed according to the present invention.

With reference to FIG. 1, a multi-piston swash plate type compressor according to this invention, generally designated by reference numeral 10, includes: a cylinder block body 12 assembled by a pair of cylinder block halves 14 and 16; dish-like housing members 18 and 20 mounted on the end faces of the assembled cylinder block body 12, respectively; and disc-like reed valve assemblies 22 and 24 disposed between the dish-like housing members 18 and 20 and the respective end faces of the cylinder block body 12. All of these components are assembled as a unit by elongated screws 26 which extend from the dish-like housing member 18 into the dish-like housing member 20 through the disc-like reed valve assembly 22, the cylinder block body 12, and the disc-like reed valve assembly 24.

The cylinder block halves 14 and 16 have a cylindrical recess formed at their opposed inner side faces, and when assembled to form the cylinder block body 12, the cylindrical recesses thereof define a swash plate chamber 28 in which a swash plate 30 is disposed. For example, each of the cylinder block halves 14 and 16 has five cylinder bores 32 formed circumferentially therein, which are spaced from each other at regular intervals. Namely, the five cylinder bores 32 are radially and concentrically formed in each of the cylinder block halves 14 and 16 with respect to a center axis thereof. The five cylinder bores 32 of the cylinder block half 14 are aligned with those of the cylinder block half 16, respectively, and each of pair of the aligned cylinder bores 32 slidably receives a common piston 34 which is engaged with the swash plate 30 in a manner as mentioned hereinafter.

The cylinder block body 12 is provided with an intake pipe (not shown) which is adapted to be connected to an evaporator of an air-conditioning system to introduce a refrigerant inclusive of a lubricating oil into the swash plate chamber 28, whereby movable parts included in the cylinder block body 12 are lubricated by the introduced refrigerant inclusive of a lubricating oil. As shown in FIG. 1, an annular seal element 36 is provided between the cylinder block halves 14 and 16, and annular seal elements 38 and 40 are provided between the dish-like housing members 18 and 20 and the end faces of the cylinder block body 12, respectively, so that the refrigerant is prevented from leaking from the compressor 10.

The cylinder block halves 14 and 16 have central axial bore sections 42 and 44 which are aligned with each other and form a central axial bore of the cylinder block body 12. A driving shaft 46 is received in the central axial bore of the cylinder block body 12 and is rotatably supported therein by radial bearings 48 and 50 which are provided in the central axial bore sections 42 and 44 in the cylinder block halves 14 and 16, respectively. The swash plate 30 is fixedly mounted on the driving shaft 46 within the swash plate chamber 28. As shown in FIG. 1, the driving shaft 46 has an end portion which is rotatably supported by the radial bearing 50 without projecting from the axial bore section 44 of the cylinder block half 16, whereas the other end portion of the driving shaft 46 terminates in a threaded end 52 of a portion thereof which extends through the central axial bore section 42 of the cylinder block half 18, the disc-like reed valve assembly 22, and the dish-like housing member 18. The threaded end 52 is adapted to be coupled to a prime motor of the vehicle for rotation of the swash plate 30.

Since the swash plate is subjected to a thrust force during a rotational operation thereof, thrust bearings 54 and 56 are provided around the driving shaft 46 and are disposed and held between the opposed sides of a central portion of the swash plate 38 and the opposite inner sides of the cylinder block halves 14 and 16, respectively.

As can be seen from FIG. 1, each of the pistons 34 has a recess 58 formed in the side thereof which is directed to the driving shaft 46, and a slot 60 which is formed at a center of the recess 58 for receiving the peripheral portion of the swash plate 30.

A pair of semi-spherical shoe elements 62, 62 are provided between the opposed sides of the peripheral portion of the swash plate 30 and the opposite side walls of the slot 60, respectively. The opposite side walls of the slot 60 have a spherical recess formed therein, which has a complemental relationship with the spherical surface of the shoe elements 62. The spherical surface of each shoe element 62 is in slidable contact with the corresponding spherical recess, whereas the circular flat surface thereof is in slidable contact with corresponding side face of the peripheral portion of the swash plate 30, whereby each piston 34 is reciprocated in the corresponding aligned cylinder bores 32 of the cylinder block halves 14 and 16 by the rotation of the swash plate 30. Note that the recess 58 of the piston 34 serves to prevent the piston 34 from interference from the periphery of the thrust bearings 54 and 56 during the reciprocation thereof.

The dish-like housing member 18 is provided with an annular partition wall 64 which is arranged therein so as to define an inner suction chamber 66 and an outer annular discharge chamber 68. Similarly, the dish-like housing member 20 is also provided with an annular partition wall 70 which is arranged therein so as to define an inner suction chamber 72 and an outer annular discharge chamber 74. In addition, the dish-like housing member 18 has a sleeve-like portion 76 formed integrally therewith, which partially surrounds the driving shaft 46, as shown in FIG. 1, and in which a well known seal assembly 78 is provided to seal the suction chamber 66 from outside so that the refrigerant is prevented from leaking from the suction chamber 66 through an annular gap between the driving shaft 46 and the sleeve portion 76.

The disc-like reed valve assemblies 22 and 24 per se are well known in this field and may be identical with each other in the illustrated embodiment. Each of the disc-like reed valve assemblies 22 and 24 includes an annular plate member 80 having five pairs of suction and discharge ports which are arranged so as to be opened to the five cylinder bores 32 of the corresponding cylinder block half, respectively. The disc-like reed valve assembly 22, 24 also includes suction and discharge reed valve plates 82 and 84 which are made of a thin metal material such as a stainless steel sheet having a five reed valve elements formed therein by, for example, stamping. The suction reed valve plate 82 is applied to the inner side face of the corresponding annular plate member 80 so that the five reed elements may close the five suction ports thereof, respectively, and the discharge reed valve plate 84 is applied to the outer side face of the corresponding annular plate member 80 so that the five reed elements may close the five discharge ports thereof, respectively. The disc-like reed valve assembly 22, 24 furthermore includes a discharge reed valve retainer plate 86 which is made of a relatively thick metal material having five tongue-like elements 88 formed therein by, for example, stamping, and tilted by bending as shown in FIG. 1. The discharge reed valve retainer plate 86 is applied to the corresponding discharge reed valve plate 84 so that the five tongue-like elements 88 may retain the five reed valve elements thereof.

Each of the cylinder block halves 14 and 16 has a refrigerant flow passage 90 which is formed in the vicinity of the corresponding central axial bore sections 42, 44 to communicate the suction chamber 28 with the corresponding suction chamber 66, 72. Note that the disc-like reed valve assembly 22, 24 has openings formed therein, each of which forms an extension of the corresponding refrigerant flow passage 90. Also, the central axial bore sections 42 and 44 of the cylinder block halves 14 and 16 serve to communicate the suction chamber 28 with the suction chamber 66 and 72, respectively. Toward this end, the disc-like reed valve assembly 22, 24 has a central opening formed therein, which forms an extension of the corresponding central axial bore section 42, 44.

Figure 2:
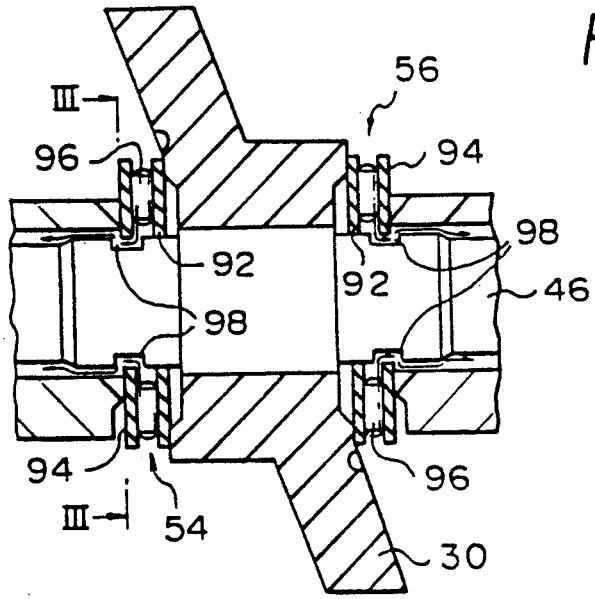
FIG. 2 is a partially enlarged view of FIG. 1, showing in detail a lubrication arrangement according to the present invention.
Figure 3:
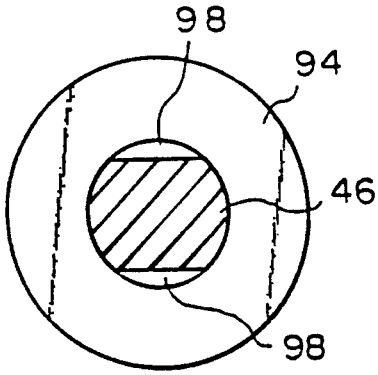
FIG. 3 is a cross-sectional view taken along the line III—III of FIG. 2.

With reference to FIG. 2 in which a feature of the present invention is best illustrated, each of the thrust bearings 54 and 56, which may be identical with each other, includes a first or inner race element 92, a second or outer race element 94, and a plurality of roller elements 96 disposed therebetween. The inner race element 92 abuts against the corresponding central side face of the swash plate 30, and the outer race element 94 abuts against an inner wall surface of the corresponding cylinder block half 14, 16. The inner race element 92 surrounds the driving shaft 46 with a clearance of 0.01 to 0.3 mm therebetween. Similarly, the outer race element 44 also surrounds the driving shaft 46 with a clearance of 0.01 to 0.3 mm therebetween, but this clearance is locally widened by forming two recesses 98 in the driving shaft 46. As shown in FIG. 3, preferably, the two recesses 98 are diametrically disposed with respect to the driving shaft 46.

In operation, rotation of the swash plate 30 causes each of the pistons 34 to be reciprocated in the corresponding pair of aligned cylinder bores 32, 32, so that one of the aligned cylinder bores is subjected to a compression stroke while the other cylinder bore is subjected to a suction stroke. During the suction stroke, each of the cylinder bores 32 sucks in the refrigerant from the suction chamber 66, 72 through the corresponding suction port with which the suction reed valve element is associated. On the other hand, during the compression stroke, each of the cylinder bores 32 discharges the compressed refrigerant into the discharge chamber 68, 74 through the corresponding discharge port with which the discharge reed valve element is associated.

The compressed refrigerant is fed to the condenser of the air-conditioning system and is then returned to the compressor 10 through the evaporator thereof. The returned refrigerant is first introduced into the swash plate chamber 28 through the intake pipe (not shown) and then flows from the periphery of the swash plate chamber 28 toward the center thereof, that is, the driving shaft 46, because of the existence of the axial bore sections 42 and 44 and the refrigerant flow passages 90 by which the swash plate chamber 28 is communicated with the suction chambers 66 and 72. A part of the refrigerant is directed to the suction chambers 66 and 72 through the refrigerant flow passages 90, and the remaining part thereof is introduced into the axial bore sections 42 and 44 through the thrust bearings 54 and 56, respectively, as designated by arrows in FIG. 2.

According to the present invention, a flow rate of the refrigerant which is introduced into the axial bore sections 42 and 44 can be considerably increased in comparison with the conventional compressor hereinbefore because of the existence of the recesses 98, so that the radial bearings 48 and 50 are sufficiently lubricated by the lubricating oil included in the introduced refrigerant. Furthermore, the undulation or wobble of the race elements of the thrust bearings can be effectively suppressed because the clearance between the race elements of thrust bearings and the driving shaft may be set less than 0.3 mm. It should be note that it is impossible to set the above-mentioned clearance less than 0.3 mm in the conventional compressor because the flow rate of the refrigerant introduced into the axial bore sections is considerably decreased. In short, according to the present invention, it is possible to introduce a sufficient amount of the refrigerant into the axial bore sections of the cylinder block halves through the thrust bearings without aggravating the undulation or wobble of the race elements of the thrust bearings.

Figure 4:
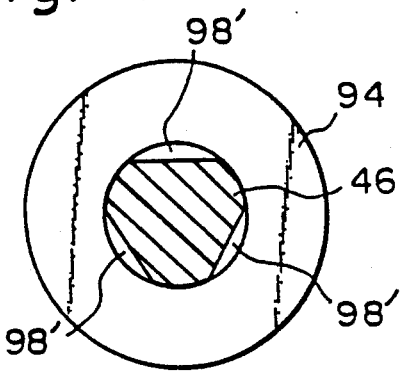
FIG. 4 is a cross-sectional view similar to FIG. 3, showing a modification of the embodiment shown in FIGS. 1 to 3.

FIG. 4 shows a modification of the embodiment shown in FIGS. 1 to 3. As shown in FIG. 4, three recesses 98′ are formed in the driving shaft 46 to increase a flow rate of the refrigerant to be introduced into the axial bore sections of the cylinder block halves, these recesses being disposed around the driving shaft 46 at regular intervals. Of course, more than three recess may be formed in the driving shaft so that they are disposed around the driving shaft 46 at regular intervals.

Figure 5:
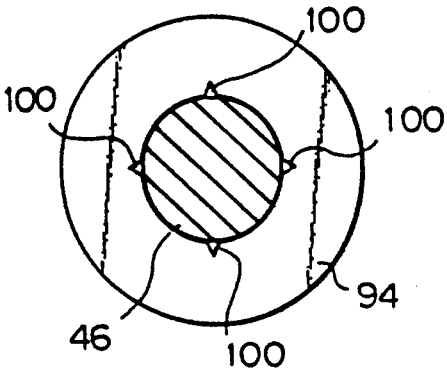
FIG. 5 is a cross-sectional view similar to FIG. 3, showing another modification of the embodiment shown in FIGS. 1 to 3.

FIG. 5 shows another modification of the embodiment shown in FIGS. 1 to 3. In this modification, four notches 100 are formed in an inner periphery of the outer race element 94 of the thrust bearing 54, 56 to locally widen the clearance between the driving shaft 46 and the outer race element 94. As can see from FIG. 4, preferably, the four notches 100 are disposed around the driving shaft 46 at regular intervals.

Figure 6:
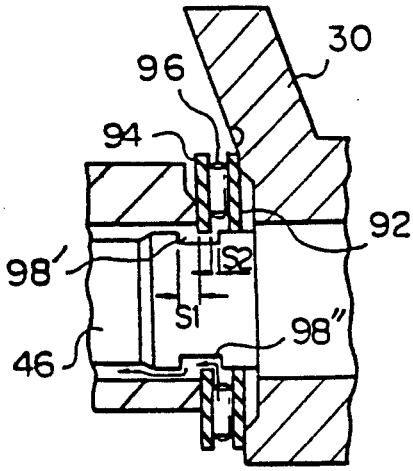
FIG. 6 is a partially enlarged view similar to FIG. 2, showing yet another modification of the embodiment shown in FIGS. 1 to 3.

FIG. 6 shows yet another modification of the embodiment shown in FIGS. 1 to 3. In this modification, each of the recesses 98″ are formed in the driving shaft 46 so that a dimension S1 is larger than a dimension S2, the dimensions S1 and S2 being measured as a distance between the outer side face of the recess 98″ and the outer side face of the outer race element 94 and as a distance between the inner side face of the recess 98″ and the inner side face of the outer race element 94, respectively. With this arrangement, the wide zone (S1) of the recess 98″ has a flow resistance lower than the narrow zone (S2) thereof, so that an introduction of the refrigerant into the axial bore sections of the cylinder block halves is facilitated because of the difference of flow resistance between the wide and narrow zones (S1 and S2) of the recess 98″.

Figure 7B:
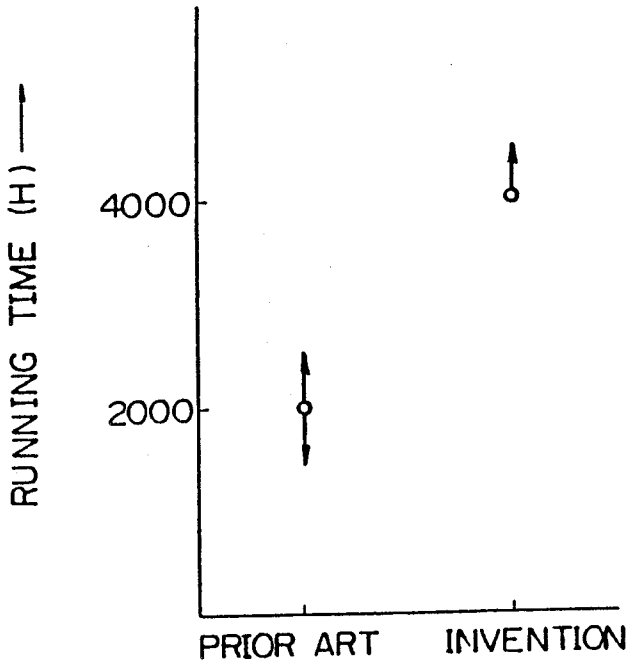
FIG. 7B is a graph showing a running time of a conventional compressor at which an undesirable play may be caused in the thrust bearings thereof and a running time of the compressor according to the present invention at which an undesirable play may be caused in the thrust bearings thereof.
Figure 7A:
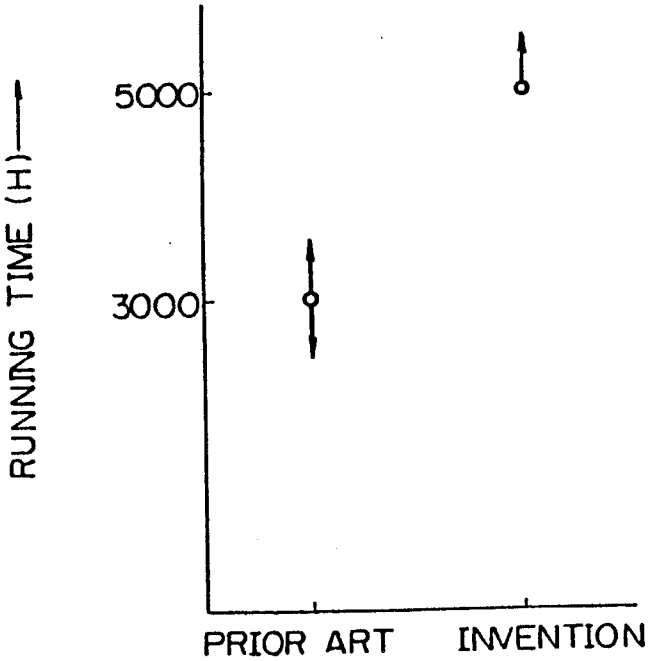
FIG. 7A is a graph showing a running time of a conventional compressor at which flaking may be caused in the radial bearings thereof and a running time of the compressor according to the present invention at which flaking may be caused in the radial bearings thereof.

As mentioned above, when the clearance between the driving shaft and the race elements of the thrust bearings is given the setting of 0.3 mm, the flaking may be caused in the radial bearings at a running time of about 3,000 hours because of insufficient lubrication thereof. On the contrary, according to the present invention, flaking of the radial bearings can be postponed until after a running time of about of 5,000 hours, as shown in FIG. 7A. Also, conventionally, the undesirable play may be caused in the thrust bearings at a running time of about 2,000 hours because of the clearance of about 0.3 mm between the driving shaft and the race elements of the thrust bearings. However, according to the present invention, an undesirable play of the thrust bearings can be postponed until after a running time of about of 4,000 hours, as shown in FIG. 7B, because the clearance can be given the setting of less than 0.3 mm.

Finally, it will be understood by those skilled in the art that the foregoing description is of preferred embodiments of the disclosed device, and that various changes and modifications may be made to the present invention without departing from the spirit and scope thereof.

We claim:

1. A multi-piston swash plate type compressor for an air-conditioning system used in a vehicle such as an automobile which comprises, in combination:

a cylinder block means in which a swash plate chamber is formed for receiving a swash plate therein, and which has cylinder bores radially and concentrically formed therein with a central axis of said cylinder block means, each of said cylinder bores receiving a piston so as to be slidably engaged with said swash plate to reciprocate said piston in the corresponding cylinder bore by rotation of said swash plate, said swash plate chamber being fed with a refrigerant inclusive of a lubricating oil from an evaporator of the air-conditioning system, said swash plate being fixedly mounted on a driving shaft which extends into said swash plate chamber through said cylinder block means, and which is operatively connected to a prime motor of the vehicle for rotation of said swash plate, said driving shaft being rotatably supported in the axial bore of said cylinder block means by thrust bearing means provided around said driving shaft at the sides of said swash plate and by radial bearing means provided within said axial bore;

housing means provided on said cylinder block means for forming a suction chamber which is communicated with said cylinder bores through a valve element and a discharge chamber which is communicated with said cylinder bores through a valve element, said suction chamber being in communication with said swash plate chamber through the axial bore of said cylinder block means, said discharge chamber being connected to a condenser of the air-conditioning system for feeding a compressed refrigerant thereto; and said thrust bearing means including a race element surrounding said driving shaft with a clearance therebetween, which has a narrow width, but is locally widened, whereby the refrigerant is able to be sufficiently introduced into the axial bore of said cylinder block means without aggravating undulation or wobble of the race element of said thrust bearing means, whereby effective lubrication of the radial bearing means is able to be carried out.

2. A multi-piston swash plate type compressor as set forth in claim 1, wherein the clearance between said driving shaft and the race element of said thrust bearing means is 0.01 to 0.3 mm and is locally widened by forming at least two recesses in said driving shaft, said recesses being disposed around said driving shaft at regular intervals.

3. A multi-piston swash plate type compressor as set forth in claim 1, wherein the clearance between said driving shaft and the race element of said thrust bearing means has a width of 0.01 to 0.3 mm and is locally widened by forming at least two notches in the race element of said thrust bearing means, said notches being disposed around an inner periphery of said race element at regular intervals.

4. A multi-piston swash plate type compressor for an air-conditioning system used in a vehicle such as an automobile which comprises:

a cylinder block body which is assembled from a pair of cylinder block halves to form a swash plate chamber therebetween, said cylinder block halves having a same number of cylinder bores which are radially and concentrically formed therein with respect to a central axis of said cylinder block body, the cylinder bores formed in one cylinder block half being aligned with the cylinder block half formed in the other cylinder block half, with said swash plate chamber therebetween;

common pistons slidably received in the pairs of aligned cylinder bores;

a swash plate member which is disposed within said swash plate chamber to be slidably engaged with said common pistons so that the pistons are reciprocated in said pairs of aligned cylinder bores, by rotation of said swash plate;

a driving shaft which extends into an axial bore formed in said cylinder block body so that it passes through said swash plate chamber and on which said swash plate is fixedly mounted, said driving shaft being rotatably supported in the axial bore of said cylinder block body by a pair of thrust bearings provided around said driving shaft at the sides of said swash plate and by a pair of radial bearings provided within the axial bore sections in said cylinder block halves;

a pair of dish-like housing members which are mounted on end faces of said cylinder block body, respectively, so as to form a suction chamber and a discharge chamber between each of said dish-like housing members and the corresponding end face of said cylinder block body; and a disc-like reed valve assembly which is disposed between each of said dish-like housing members and the corresponding end face of said cylinder block body so that each of said cylinder bores is communicated with the corresponding suction and discharge chambers through the corresponding suction and discharge reed valve elements of said disc-like reed valve assembly;

each of said thrust bearings including first and second race element and a plurality of roller elements disposed therebetween, said first race elements abutting against the corresponding side of said swash plate member, said second race element abutting against an inner wall surface of the corresponding cylinder block half to surround said driving shaft with a clearance therebetween, which has a narrow width, but is locally widened, whereby the refrigerant is able to be sufficiently introduced into the axial bore section of the corresponding cylinder block half without aggravating undulation or wobble of said second race element, whereby effective lubrication of said radial bearings is able to be carried out.

5. A multi-piston swash plate type compressor as set forth in claim 5, wherein the clearance between said driving shaft and said second race element is 0.01 to 0.3 mm and is locally widened by forming at least two recesses in said driving shaft, said recesses being disposed around said driving shaft at regular intervals.

6. A multi-piston swash plate type compressor as set forth in claim 5, wherein the clearance between said driving shaft and said second race element is within the range from 0.01 to 0.3 mm and is locally widened by forming at least two notches in said second race element, said notches being disposed around an inner periphery of said second race element at regular intervals.

* * * * *